United States Patent [19]

Zills

[11] 4,401,245

[45] Aug. 30, 1983

[54] COLLAPSIBLE, INSULATIVE BEVERAGE CONTAINER CARRIER

[75] Inventor: Robert V. Zills, Winter Haven, Fla.

[73] Assignee: Crymes Enterprises, Inc., Tucker, Ga.

[21] Appl. No.: 285,631

[22] Filed: Jul. 21, 1981

[51] Int. Cl.[3] ..... B65D 23/08

[52] U.S. Cl. ..... 224/148; 150/52 R; 215/12 A; 215/13 R

[58] Field of Search ..... 224/148, 191, 218, 223, 224/224, 226, 228; 220/408, 412, 902; 215/12 A, 13 R; 206/545; 150/52 R, 52 J

[56] References Cited

U.S. PATENT DOCUMENTS

| | | | |
|---|---|---|---|
| 1,723,731 | 8/1929 | Hafling | 224/148 X |
| 1,949,677 | 3/1934 | Crawford | 215/12 A |
| 2,494,632 | 1/1950 | Rodin | 224/148 X |
| 2,731,182 | 1/1956 | Higgins | 215/13 R X |
| 3,085,612 | 4/1963 | Gobel | 150/52 R |
| 4,197,890 | 4/1980 | Simko | 150/52 R X |
| 4,282,279 | 8/1981 | Strickland | 150/52 R |

*Primary Examiner*—Steven M. Pollard

*Attorney, Agent, or Firm*—Lowe, King, Price & Becker

[57] ABSTRACT

A carrier (10) for a beverage container (14) comprising an insulated jacket (10) completely surrounding the sidewall of the container and having an open upper end (18) defining a mount. A longitudinal slit (26) is formed in the jacket (12) at the upper end and a closure band (30), extending across the slit, is releasable securable to the jacket to enable the jacket mouth (18) to receive beverage containers of various shapes and sizes. A pocket (36) sewn on the jacket carries cigarettes or accessories that may be enclosed by a cover flap (38). The user holds the jacket by a gripping strap (26) secured on the outer surface of the jacket (12) opposite the pocket (36).

7 Claims, 8 Drawing Figures

Fig. 1
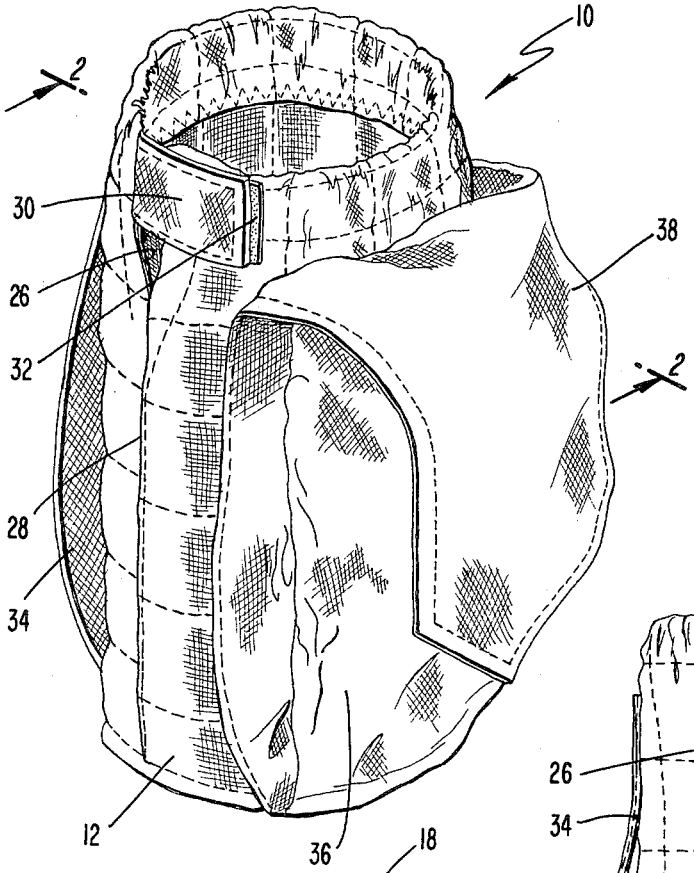
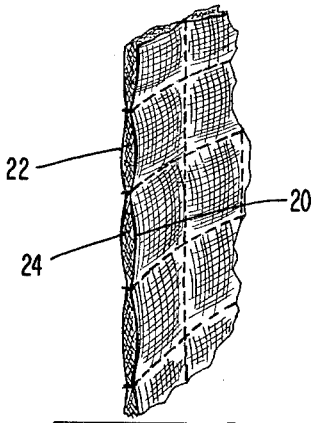
Fig. 1a
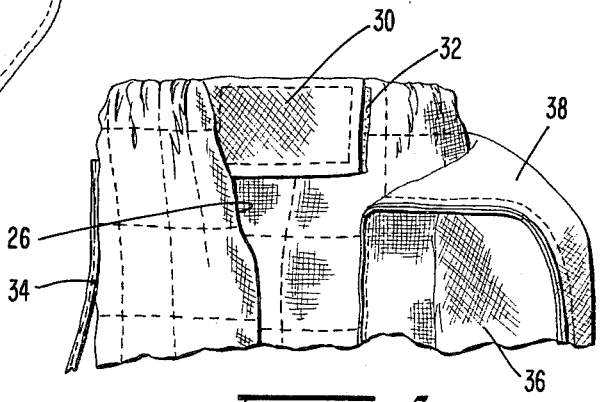
Fig. 3
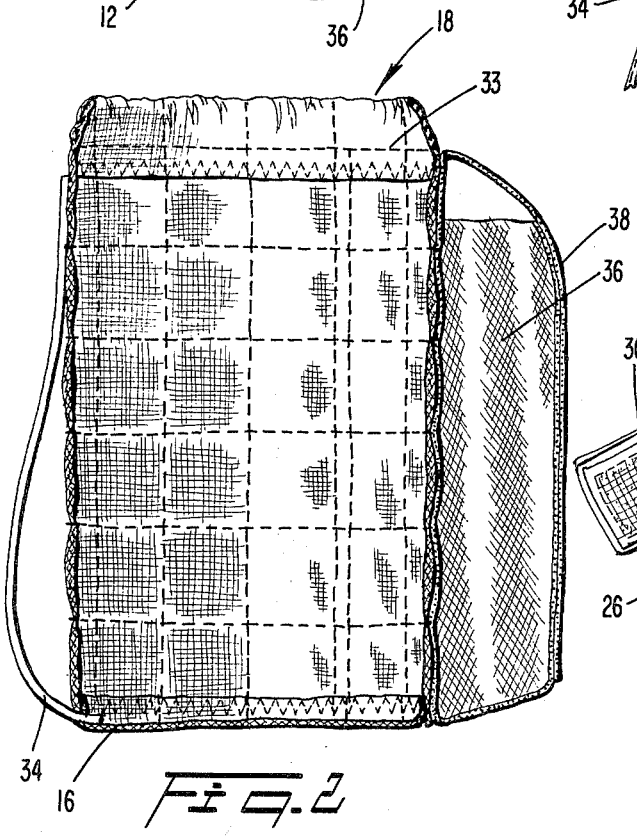
Fig. 2
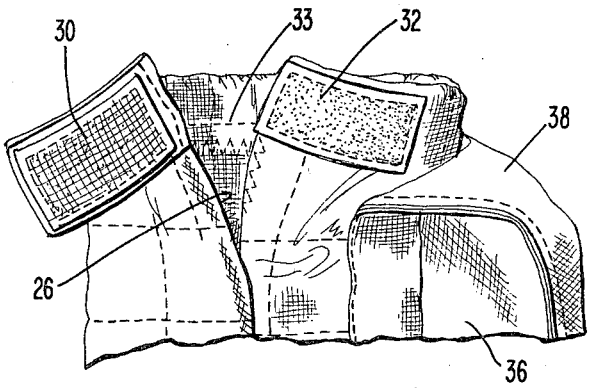
Fig. 4

Fig. 5
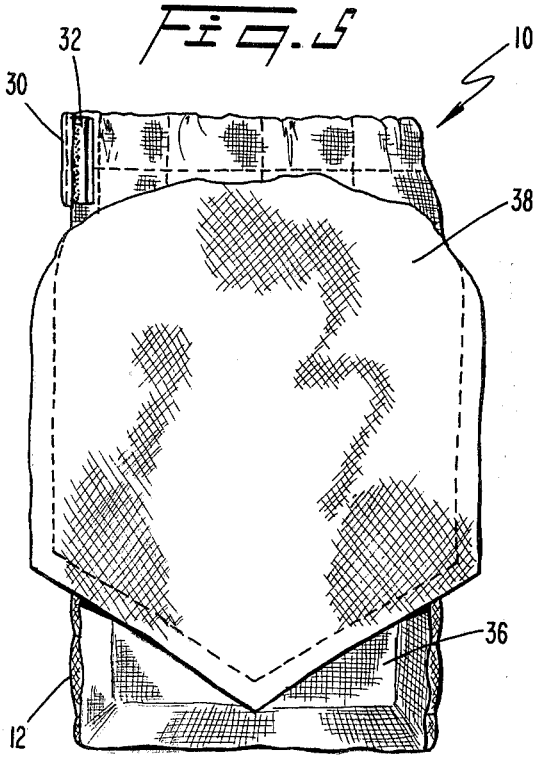
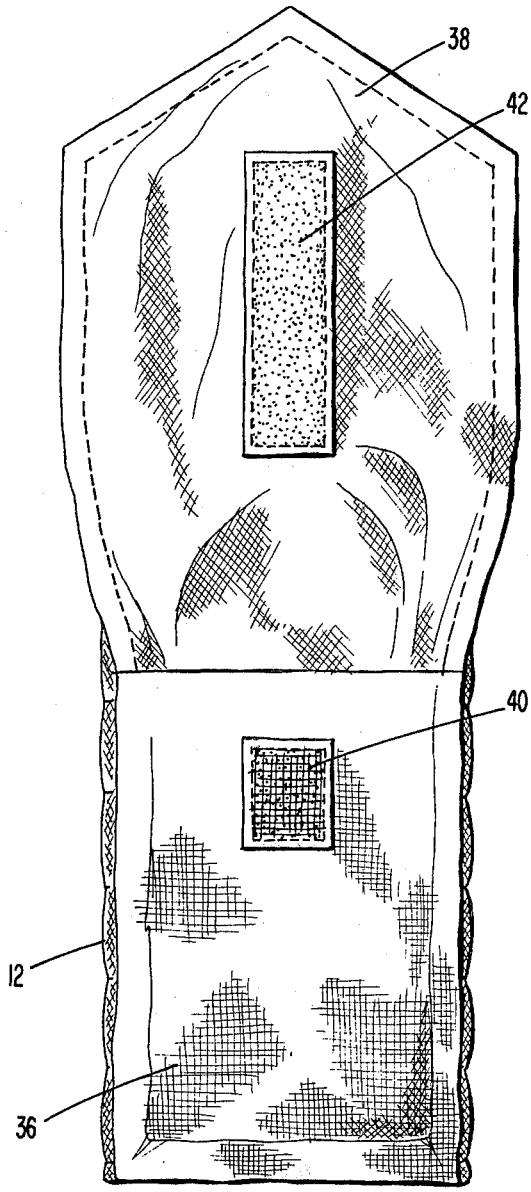
Fig. 6
Fig. 7
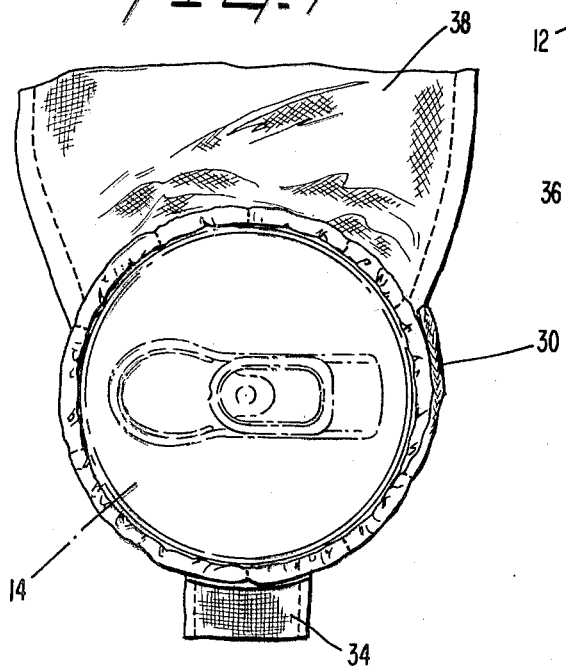

COLLAPSIBLE, INSULATIVE BEVERAGE CONTAINER CARRIER

TECHNICAL FIELD

The present invention relates generally to container carriers and more particularly to a beverage container carrier that is insulated to maintain a constant beverage temperature and is foldable for compact storage.

BACKGROUND ART

It has become commonplace at sporting events and other activities to quench thirst by consuming beer or softdrinks. These beverages are typically supplied in bottles, cans or other containers of various shapes and sizes. The bottles or cans tend to be uncomfortable to hold since the beverages are chilled. Furthermore, it is important to maintain the beverages at a preferred temperature over a period of time if the beverage is not to be immediately consumed.

One object of the present invention, therefore, is to provide a canned or bottled beverage carrier that isolates the hand from the surface of the bottle or can and provides insulation to maintain a nearly constant beverage temperature.

Another object is to provide a beverage bottle or can carrier that is convenient to grip with one hand.

Another object is to provide a beverage bottle or can carrier that is capable of holding beverage bottles, cans or other containers of various shapes and sizes.

A further object of the invention is to provide a carrier for beverage bottles, cans or other containers wherein the carrier is collapsible for convenient and compact storage.

DISCLOSURE OF INVENTION

An insulated, collapsible carrier for a beverage container, such as a bottle or can, comprises an insulated jacket of receiving the container and a longitudinal gripping strap secured to and extending along substantially the entire height of the outer surface of the jacket. A longitudinal slit formed at the upper end of the jacket provides a variable diameter opening or mouth for receiving beverage containers of various sizes and shapes. A closure band, which may be formed of Velcro TM, is positioned at and parallel to the upper end of the jacket. This band extends across the slit, and different portions of the band are releasably securable to the jacket to enclose the mouth of the jacket tightly against the surface of the container.

A pocket for storing cigarette packs or other articles is secured to the surface of the jacket opposite the gripping strap. A cover flap extends downwardly from the upper end of the pocket for sealing.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF DRAWINGS

FIG. 1 is a perspective view of a preferred embodiment of the beverage container carrier in accordance with the invention;

FIG. 1*a* is a cross sectional view showing the construction of the insulative jacket;

FIG. 2 is a side elevational view of the carrier of FIG. 1;

FIG. 3 is a partial view of the carrier showing the jacket mouth enclosed by the Velcro TM closure band;

FIG. 4 is a partial view corresponding to FIG. 3 showing the jacket mouth open to expose the Velcro TM closure band;

FIG. 5 is a front elevational view of the carrier illustrating the configuration of the accessory pocket;

FIG. 6 is a front view corresponding to FIG. 5 with the accessory pocket open to expose the Velcro TM closure strips.

FIG. 7 is a top view of the carrier with a beverage container enclosed therein.

BEST MODE FOR CARRYING OUT THE INVENTION

Referring to FIG. 1, a carrier 10 for a beverage container such as a can or bottle of arbitrary shape and size comprises an insulative jacket 12 completely surrounding the container (see FIG. 7 illustrating an exemplary can 14). The jacket 12 has a closed lower end 16 for supporting the can or bottle and an open upper end 18 forming an axis opening. The jacket 12 is formed of inner and outer, water resistant fabric layers 20 and 22 within which is disposed a layer of insulative material 24, all quilted together as shown in FIG. 1*a*. The jacket 12 preferably has a cylindrical configuration, as shown in the Figures, but it is to be understood that other configurations conforming to shapes of particular containers to which the carrier 10 is adapted may be provided. The carrier 10, being formed completely from fabric material, may be folded or rolled following use for compact storage in a pocket or purse.

A longitudinal slit 26 formed in the jacket 12 adjacent upper end 18 is established by an open jacket portion within side seam 28. A closure band 30 parallel to and positioned at the upper end or mount 18 of jacket 12 extends across the slit 26 to enclose the mouth 18 around the beverage container, as shown in FIG. 7. The inner surface of closure band 30 is covered by a strip of Velcro TM or other fastening material to releasably secure the band 30 to a correspoonding band 32 on the other surface of the jacket 12 (see FIG. 4). Because the closure bands 30 and 32 are preferably formed of Velcro TM, the diameter of access opening 18 is infinitely adjustable to accommodate virtually any standard 8 or 16 ounce beverage bottle or can, for example.

An elastic thread 33 sewn into the jacket 12 at upper end 18 causes the upper end to yield to bottles or containers of different diameters and to tightly grip the bottle or can when the Velcro TM closure straps 30, 32 are secured together.

Referring to FIG. 2, a gripping strap 34 attached to the outer surface of jacket 12 extends along substantially the entire height of the jacket to enable the strap to loop around one hand of the user for support. The upper end of strap 34, sewn onto the outer surface of jacket 12, is parallel to the jacket sidewall whereas the lower end, sewn to the base 16, is perpendicular to the sidewall. This structure provides additional clearance to the hand while also ensuring sufficient structural support under heavy loading by a filled beverage container.

Referring to FIGS. 5 and 6, a pocket 36 is sewn onto the outer surface of jacket 12 at a position approximately opposite gripping strap 34. The pocket 36 supports a cigarette package or other article to be carried along with beverage container 14. A flap 38 at the upper end of the pocket 36 extends downwardly to enclose the pocket and thereby protect its contents. A strip 40 formed of Velcro TM or other fastening material is sewn onto the surface of jacket 12 beneath flap 38. A corresponding strip 42 is sewn on the inner surface of the flap 38 as shown in FIG. 6. The strip 42 is substantially longer than the strip 40 to enable the strip 40 to be secured at any point along the length of strip 42. These strips could, of course, be reversed, i.e., the longer strip 42 could be positioned on pocket 36 rather than on flap 38. This enables the flap 38 to be folded over the pocket 36 and secured closed independently of the size of the article carried in the pocket.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

I claim:

1. An insulated, collapsible carrier for a beverage container, said carrier comprising an insulated jacket having an open upper end for receiving said container, said jacket completely surrounding a sidewall of said container, a longitudinal slit formed in said jacket at the upper end thereof, a closure band positioned at and parallel to the upper end of said jacket, said band extending across said slit and different portions of said band being releasably securable to said jacket to provide a variable diameter opening for receiving various beverage containers; a longitudinal gripping strap extending along substantially the entire height of said jacket and adapted to wrap around a user's hand; a pocket secured on said jacket; a cover flap extending downwardly from an upper end of said pocket; and means for releasably securing said cover flap to said pocket.

2. The carrier of claim 1, wherein said flap securing means includes a first securing strip on one of said flap and said pocket and a second, elongated securing strip on the other one of said flap and said pocket, said second strip being releasably securable at different portions thereof to said first strip to receive articles of various sizes within said pocket.

3. The carrier of claim 2, wherein said first and second securing strips are formed of Velcro TM.

4. The carrier of claim 1, wherein said closure band is formed of Velcro TM.

5. The carrier of claim 1, wherein said jacket is formed of an inner fabric layer and an outer fabric layer; and an insulative layer between said inner and outer layers, said inner, insulative and outer layers being quilted.

6. An insulated, collapsible carrier for a beverage container, said carrier comprising an insulated jacket having an open upper end for receiving said container, a longitudinal slit formed in said jacket at the upper end thereof; a Velcro TM closure band positioned at and parallel to the upper end of said jacket, said band extending across said slit and releasably securable to said jacket to provide a variable diameter opening for receiving various beverage containers; and a longitudinal gripping strap extending across substantially the entire height of said jacket, said gripping strap being adapted to surround a user's hand, including a pocket secured on said jacket, a cover flap extending downwardly from an upper end of said pocket, and Velcro TM securing means for releasably securing said cover flap closed, said securing means including a first Velcro TM strip on one of said flap and said pocket and a second elongated Velcro TM strip on the other one of said flap and said pocket, said first strip being releasably securable to different portions of said second elongated strip to enable articles of various sizes to be received in said pocket.

7. The carrier of claim 1 or claim 6, wherein an upper end of said gripping strip is formed parallel to a sidewall of said jacket and a lower end of said strap is formed perpendicular to said jacket sidewall.

* * * * *